United States Patent [19]

McCafferty

[11] 4,330,121

[45] May 18, 1982

[54] AERODYNAMIC DRAG ATTACHMENT FOR SWUNG ATHLETIC IMPLEMENTS

[75] Inventor: James McCafferty, San Diego, Calif.

[73] Assignee: Swisher Associates, San Diego, Calif.

[21] Appl. No.: 193,020

[22] Filed: Oct. 2, 1980

[51] Int. Cl.[3] ..... A63B 69/36; A63B 69/40

[52] U.S. Cl. ..... 273/26 B; 273/186 C

[58] Field of Search ..... 273/186 A, 193 R, 193 A, 273/193 B, 194 R, 194 A, 194 B, 26 B

[56] References Cited

U.S. PATENT DOCUMENTS

| | | | |
|---|---|---|---|
| 2,608,409 | 8/1952 | Pinkerton | 273/194 B |
| 2,935,321 | 5/1960 | Lhotka | 272/124 X |
| 3,647,220 | 3/1972 | Burkart | 273/194 B |
| 3,809,397 | 5/1974 | Gruenewald | 273/26 B |

FOREIGN PATENT DOCUMENTS

| | | | |
|---|---|---|---|
| WO 80/00062 | 1/1980 | World Intel. Prop. Org. | 273/186 A |

OTHER PUBLICATIONS

"Golf Digest", Mar. 1979, pp. 110 and 111.

*Primary Examiner*—George J. Marlo

*Attorney, Agent, or Firm*—LeBlanc, Nolan, Shur & Nies

[57] ABSTRACT

Player swung devices equipped with accessories designed to increase aerodynamic drag or air resistance and thereby promote the development of muscular strength and coordination. The accessories are aerodynamically neutral and are so constructed that they can be slipped over, and secured to, a barrel, shaft, or comparable part of the player swung device or fabricated as an integral part of the device.

The accessory is in the form of a hollow, thin shelled sphere of from 2–18 inches in diameter, with opposed openings through which the shaft of the player device is inserted. Each opening includes an array of deflectable tabs thereabout to functionally engage the accessory onto the player device shaft. The tabs may be integral with the sphere or formed on inserts mounted within the openings. An additional wedge arrangement may be provided with the tab or a hook and eye or "Velcro" type fastener may supplement the tabs in holding the accessory on the device.

3 Claims, 10 Drawing Figures

82
80
74
72
28
34
24
78
30
76

8
8
84
92
94
100

88
98
102
96
86

111
84
98
86
96
104
112
108
110
106

24

94
92
88
90
86

136
134

138
126
124
132
122
120
128
118
114
116
130
86
84

AERODYNAMIC DRAG ATTACHMENT FOR SWUNG ATHLETIC IMPLEMENTS

The present invention relates to player swung devices such as bats and clubs and, more particularly, to novel improved accessories with which such player swung devices can be equipped to promote the development of muscular strength and coordination as the user swings the device.

Such accessories are particularly useful with golf clubs and baseball bats, and the principles of the present invention will accordingly be developed primarily by reference to such applications of my invention. It is to be understood, however, that this is being done for the sake of brevity and clarity and is not intended to limit the scope of the invention as defined in the appended claims. Those skilled in the art will readily recognize in this respect, and as my disclosure proceeds, that other types of bats—for example cricket bats—and racquets and other kinds of player swung devices can also be advantageously equipped with accessories of the type disclosed herein.

Numerous devices with which a bat or club-type device can be equipped or modified to promote muscle development and coordination as the user swings the device have heretofore been proposed. The earliest developed devices for this purpose of which I am aware utilize weights of various types. These require that more force be exercised to swing the device with which they are equipped; and this, in turn, leads to a more rapid development of the user's muscles. Coordination can also be developed by this technique.

Among the heretofore proposed devices or accessories of the character just described are those disclosed in U.S. Pat. Nos. 1,524,196 issued Jan. 27, 1925, to Matthews; 2,143,337 issued Jan. 10, 1939, to Walton; 3,330,560 issued July 11, 1967, to Higdon; 3,521,883 issued July 28, 1970, to Hamilton; 3,647,220 issued Mar. 7, 1972, to Burkhart et al; 3,623,724 issued Feb. 9, 1970, to Lande; 3,716,239 issued Feb. 13, 1973, to Goudreau; and 3,820,785 issued June 28, 1974, to Occhipinti et al.

It was implicitly recognized in the Walton patent identified above that aerodynamic drag adds to the force required to swing a device of the type with which I am concerned, and a baseball bat with inherent aerodynamic drag was later disclosed in U.S. Pat. No. 3,463,492 issued Aug. 26, 1969, to White.

Later, accessories or devices deliberately designed to generate aerodynamic drag and thereby promote muscle development and coordination by air resistance to the swinging of a device by the user were disclosed in U.S. Pat. No. 3,508,748 issued Apr. 28, 1970, to Strimel; U.S. Pat. No. 3,809,397 issued May 7, 1974, to Grunewald; and in U.S. Pat. No. 4,183,526 issued Jan. 15, 1980, to Brown.

Drag generating exercise devices have the advantage that their effect increases as the devices with which they are equipped are swung with greater velocity. Also, they continue to be effective during the follow through portion of a swing. In contrast, inertial type devices tend to propel the swung device during that portion of the swing; they consequently produce less conditioning or muscle development.

The heretofore proposed aerodynamic drag type exercise devices disclosed in the above cited patents however all have vanes or parts that are aerodynamically equivalent to vanes. They consequently have the disadvantage that they generate lift and, also, twist about the centerline of the devices with which they are equipped as the latter are swung. These lift and torque forces furthermore vary as the velocity of the accessory equipped device changes and as the device rotates relative to its initial orientation as it invariably does.

Both lift and the twisting of the accessory equipped device are undesirable. They distort the swing which the user of the device is invariably trying to perfect by changing the forces and feel which the user normally experiences as these forces are normally not present. The user will accordingly, automatically and unconsciously, adjust his swing to compensate for these forces. Consequently, when he returns to an accessory free, player swung device, unwanted anomalies will have been introduced into his swing. Therefore, while muscle development may have been achieved, the net effect of using the exercise accessory may in many, if not most, cases actually be negative.

I have now developed novel, improved, aerodynamic drag or air resistance type exercise accessories for player swung devices which eliminate the above-discussed disadvantages of heretofore proposed accessories of that character.

In general, my novel accessories have a configuration which, by itself, or in association with the player swung device, is essentially aerodynamically neutral. As a practical matter, spherical configurations are preferred.

My accessories also have a bore along a major diameter for fitting the accessory over the shank, barrel, or comparable part of a player swung device and one or more frictional couplings for securing the accessory to the player swung device.

The accessory is dimensioned to produce drag in an amount that is effective to promote muscular development and/or coordination as the accessory equipped device is swung. The drag or air resistance effect can be increased by employing a thin shell construction with a uniformly spaced array of apertures through the shell.

My novel exercise devices or accessories are essentially free of the swing distorting, lift and torque effects of heretofore proposed, drag or air resistance type accessories for player swung devices because they remain aerodynamically neutral throughout the entire swing of the devices with which they are equipped. That is, irrespective of the orientation of the player swung device, no unbalanced lateral forces such as lift are generated; and neither are forces capable of twisting the player swung device about its centerline. Consequently, the forces and feel experienced by the user remain essentially normal; but additional muscular effort is required because of the increased resistance to swinging afforded by the accessory generated, aerodynamic drag.

Other important, not to be discounted, attributes of my novel exercise devices are simplicity, durability, and ease of attachment and removal. The importance of the latter are self-evident. Simplicity is important for its own sake, and because it leads to ease of manufacture and to low cost.

From the foregoing it will be apparent to the reader that one important and primary object of my invention resides in the provision of novel, improved devices or accessories usable with player swung devices to develop muscular strength and/or coordination.

A related, but more specific, object of that invention is to provide accessories of the character just described which meet the stated objectives by generating aerodynamic drag or air resistance and which are at least essentially free of the aerodynamic imbalance and appurtenant, unwanted effects on the user's swing possessed by heretofore proposed exercise devices employing that physical principle.

Still other important, but more specific, objects of the invention reside in the provision of devices or accessories of the character described above:

which can be easily installed on and removed from the player swung devices with which they are used;

which, alternatively, can be made as integral parts of player swung devices;

which are simple and durable;

which are easy and relatively inexpensive to manufacture;

which possess various combinations of the foregoing attributes.

Other important objects, features, and advantages of my invention will become apparent from the appended claims and as the ensuing detailed description and discussion proceeds in conjunction with the accompanying drawing, in which:

Figure 9:
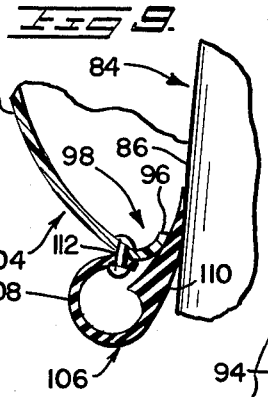
Figure 10:
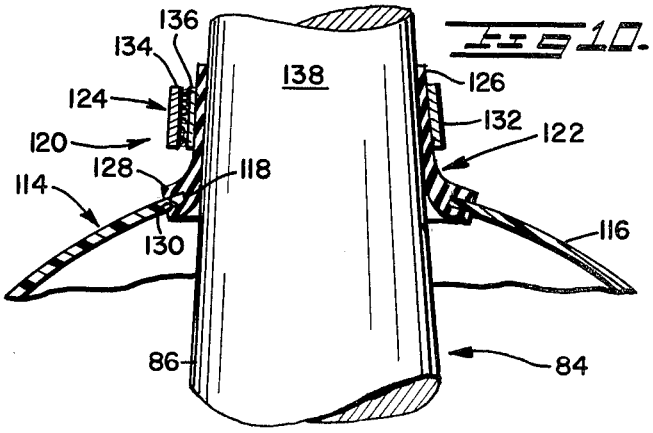

FIG. 9 is a fragmentary view of a bat/exercising device assembly embodying the principles of my invention showing an optional feature that can be employed to more positively retain the exercise device in place; and FIG. 10 is a fragmentary view of still another bat/exercising device assembly showing yet one more alternative in accord with the principles disclosed herein that can be employed to retain the exercise device in place on the barrel of the bat.

Figure 1:
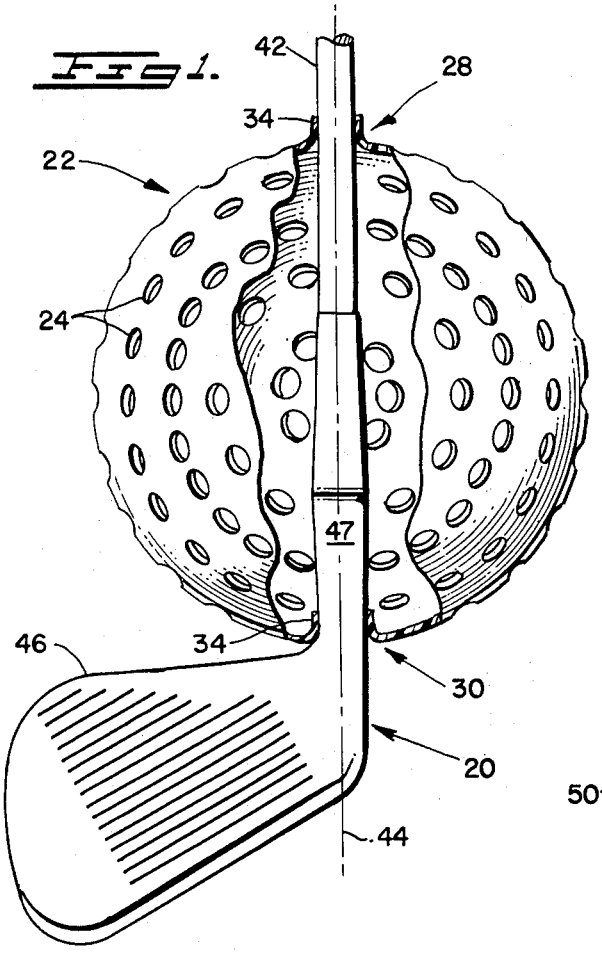
FIG. 1 is an elevation of a golfing iron equipped with an exercise device embodying and constructed in accord with the principles of the present invention, part of the exercise device being broken away to more clearly show the manner in which it is attached to the iron.

Referring now to the drawing, FIG. 1 depicts a golfing iron 20 equipped with an exercise device 22 embodying and constructed in accord with the principles of my invention.

The exercise device is a hollow, thin wall sphere in which a uniformly spaced or distributed array of apertures 24 is formed.

For applications of the character illustrated in FIG. 1, exercise device 22 can be from 2 to 12 inches in diameter although a diameter in the range of 6 to 8 inches is preferred.

As discussed above, the exercise devices I have invented promote the development of muscular strength and coordination via the employment of aerodynamic drag. Devices smaller than 2 inches in diameter are not capable of generating sufficient drag to be effective. On the other hand, the increased drag generated by devices with diameters exceeding 12 inches is not believed to be beneficial in golfing applications; and, furthermore, devices larger than that are too bulky to carry in a golf bag which is disadvantageous for self-evident reasons.

Another factor that is important in the application of my invention is the ratio d/D where "d" is the diameter of apertures 24 and "D" is the diameter of exercise device 22. This ratio can range up to 0.3 although a ratio of about 0.1 is preferred.

Above the maximum ratio just identified, the device is not capable of generating sufficient drag to make it effective.

Figure 2:
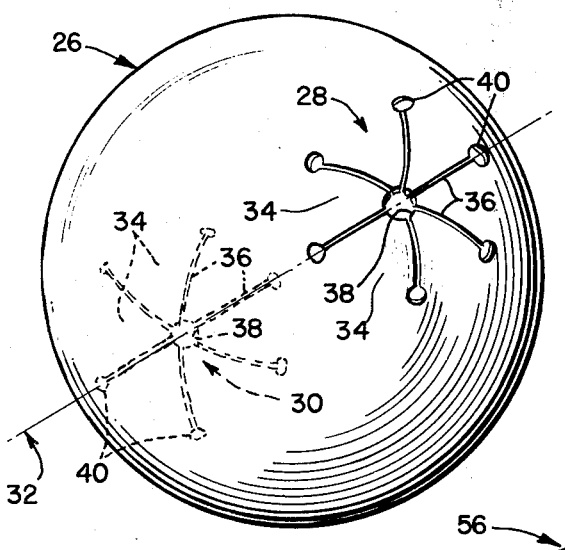
FIG. 2 is a perspective view of a second form of exercise device embodying the principles of the invention.

The other limit of the d/D ratio is 0. This translates, in physical terms, into a device with no apertures; i.e., one which is imperforate. A device of that character, also embodying the principles of the present invention, is illustrated in FIG. 2 and identified by reference character 26.

A final feature of both exercise device 22 and exercise device 26 is frictional couplings for securing the exercise device to the club, bat, or other player swung device with which it is associated.

Exercise devices 22 and 26 each have identical two couplings. These are identified by reference characters 28 and 30 in both figures.

Couplings 28 and 30 are located at opposite ends of a major diameter 32 through the device. Each includes an annular array of tabs 34 which are concentrically disposed about major diameter 32, extend inwardly toward that axis, and terminate adjacent it at their free ends.

The tabs 34 in each coupling device are defined by an equiangularly spaced, radially extending array of slits 36 in the device. Typically, as shown in FIG. 2, six such slits, defining an equal number of tabs, will be used.

Also, an aperture 38 is typically formed in the exercise device at the inner ends of slits 36 to blunt the inner ends of tabs 34 and thereby keep them from fraying. Somewhat smaller apertures 40 are, again typically, formed at the outer ends of the slits to inhibit tearing.

Referring now specifically to FIG. 1, an exercise device of the character just described is detachably installed on a golf club such as the iron 20 identified in that figure by so orienting it with respect to the shaft 42 of the club that the axis 32 of the device is coincident with the axis of elongation 44 of the shaft. The device is then slid down over the shaft until it reaches the illustrated position adjacent the head 46 of the club.

As the exercise device is pushed onto the shaft 42 of the club, the tabs 34 of the two frictional couplings 28 and 30 are bent toward the grip end (not shown) of the shaft as is shown in FIG. 1. The tabs 34 of the two coupling devices 28 and 30 consequently grip the shaft 42 and hosel 47, respectively, of the club, securing the exercise device in place.

Exercise devices of the type just described can be fabricated from a wide variety of materials of varying thicknesses.

Typically, the thickness will approach the minimum needed for structural integrity in order to conserve material and reduce cost. However, other desiderata may dictate that the device be thicker. For example, by increasing the thickness, and therefore the mass, of the device, inertial effects can be obtained in addition to aerodynamic drag, if desired.

The choice of material will typically be determined by economic, aesthetic, and similar considerations, the desirability of inducing inertial effects as the accessory equipped device is swung, etc. It is important, however, that the material be one which has resiliency. This is necessary so that tabs 34 can be bent or deformed as the exercise device is installed and removed and so that the tabs will be resiliently biased against the shaft, hosel, or other part of the player swung device on which the exercise device is installed to frictionally secure the device in place.

Player swung devices equipped with my invention, as just described, can be used for physical conditioning, for warming up, or for both of these purposes. In any case it is aerodynamic drag which furnishes resistance to the swinging of the device and thereby promotes the development of muscular strength and coordination during both the initial and follow through portions of a swing.

Those equipped with my novel accessories are superior to player swung devices with heretofore proposed accessories employing aerodynamic drag because they are essentially aerodynamically neutral. Consequently, they do not deflect the player swung device from the path it would otherwise take or otherwise distort the forces and feel expected and experienced by the user as the various prior art devices do.

Figure 3:
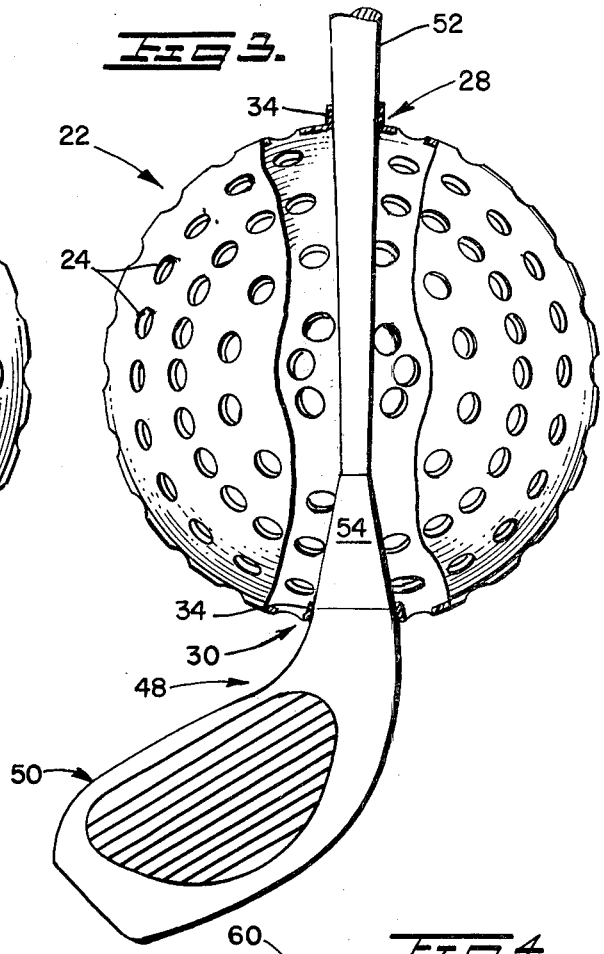
FIG. 3 is a view similar to FIG. 1 of a golfing wood equipped with an exercise device as shown in FIG. 1.

Referring again to the drawing, FIG. 3 depicts a golfing wood 48 on which the same exercise device 22 illustrated in FIG. 1 has been installed. Here, too, the exercise device is securely held in place adjacent the head 50 of the club by the engagement of frictional coupling tabs 34 with the shaft 52 and hosel 54 of the club.

As discussed above, exercise devices of the type illustrated in FIGS. 1–3 must be made of a relatively flexible material for frictional couplings 28 and 30 to perform satisfactorily.

Particularly in exercise devices of larger diameters, structural integrity—e.g., resistance to deformation or change in shape as the device-associated bat, club, etc. is swung—requires that a material which is too inflexible to meet the criteria just described be employed. In such circumstances, the exercise device can in main part be made of a more rigid material for structural integrity and the frictional couplings fabricated, as separate components, from a material which is elastically resilient.

Figure 4:
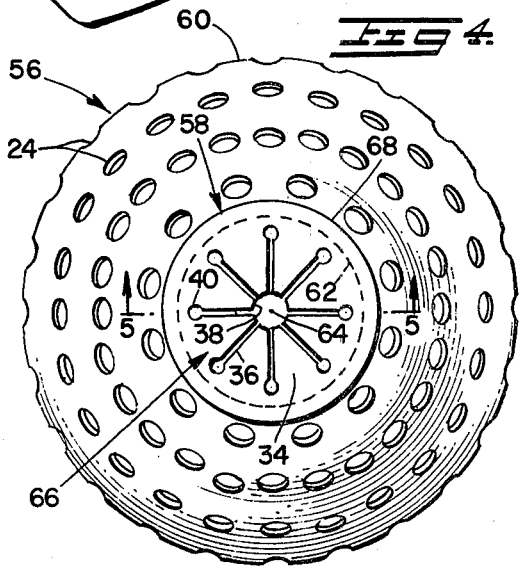
FIG. 4 is a top view of a third form of exercise device in accord with the principles disclosed herein which has a modified form of attaching it to a player swung device.
Figure 5:
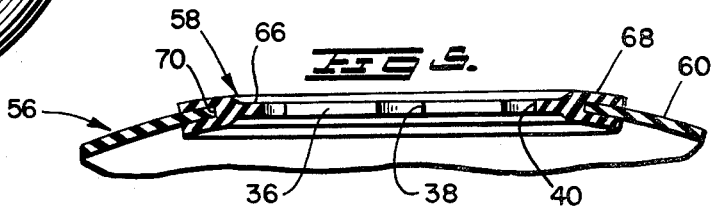
FIG. 5 is a partial section through the exercise device of FIG. 4, taken substantially along line 5—5 of the latter.

An exercise device of that character is illustrated in FIGS. 4 and 5 and identified by reference character 56.

Aside from the separate component type frictional couplings (only one of which, 58, is illustrated), exercise device 56 may duplicate the device 22 shown in FIG. 1. Therefore, to the extent that the two exercise devices are alike, the same reference characters will be employed to identify features which are the same.

Turning again to FIGS. 4 and 5, then, exercise device 56 includes, in addition to the two frictional couplings, a hollow, apertured (or imperforate), spherical shell 60 as described above. Openings 62 (only one of which is shown) are provided in the shell at opposite ends of a major diameter 64. The two frictional devices, of which only that identified by reference character 58 will be referred to in detail hereinafter, are installed in the openings.

Frictional coupling 58 is a grommet-like component with a relatively thin, circular, central section 66 in which tabs 34 are formed by slits 36, central opening 38, and holes 40, all as described above.

The central portion 66 of frictional coupling 58 is surrounded by an integral rim 68, typically of considerably greater thickness for structural integrity. A circumferentially extending slot 70 is formed in this rib or rim portion of the frictional coupling.

With the frictional coupling 58 assembled to the shell 60 of the exercise device 56, that part of the shell surrounding opening 62 is seated in slot 70 as shown in FIG. 4, securely attaching the frictional coupling to the shell of the exercise device.

Figure 6:
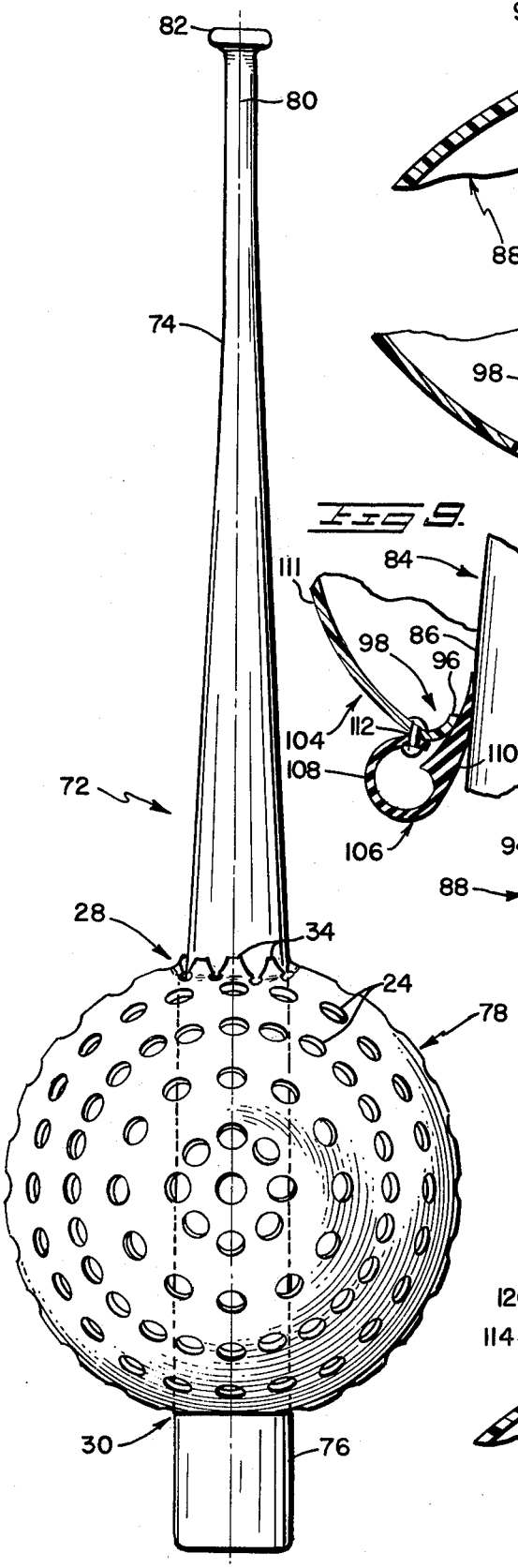
FIG. 6 is an elevation showing an exercise device of the type illustrated in FIG. 1 attached to a bat with a straight or cylindrical barrel.

Referring again to the drawing, FIG. 6 is included to demonstrate that exercise devices of the type I have invented can be used with bat- as well as club-type, player swung devices.

The player swung device 72 shown in FIG. 6 is a conventional baseball bat with a tapered handle 74 and a cylindrical barrel 76.

The exercise device 78 with which bat 72 is equipped is essentially identical to the device 22 illustrated in FIG. 1, and its components will accordingly be identified by the same reference characters. For bat-type applications, however, the diameter of the exercise device is increased to in the range of 12 to 18 inches although the d/D ratio remains the same. That is, it may range from 0, in which case there are no apertures, up to 0.3.

Exercise device 78 is installed on bat 72 in a manner akin to that described above. Specifically, the frictional couplings 28 and 30 are aligned with the axis of elongation 80 of the bat at its handle end 82 and the device then slid down over the bat until it is positioned on barrel 76 as shown in FIG. 6. Again, the tabs 34 of the frictional couplings 28 and 30 (only those of coupling 28 are shown) securely fix the exercise device in position on the bat.

Figure 7:
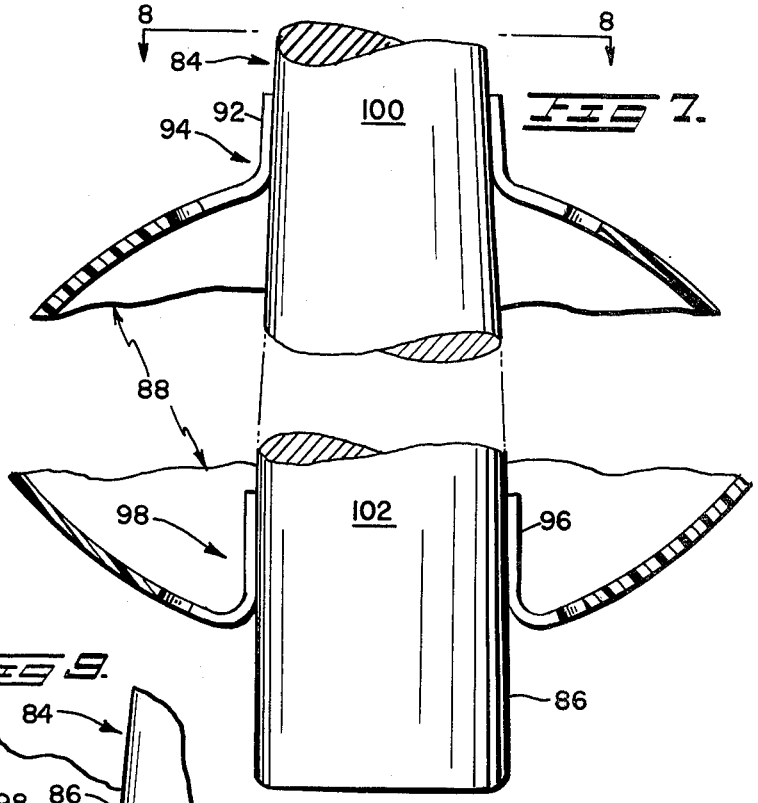
FIG. 7 is a partial elevation of a tapered bat with an exercise device embodying the principles of my invention installed thereon.
Figure 8:
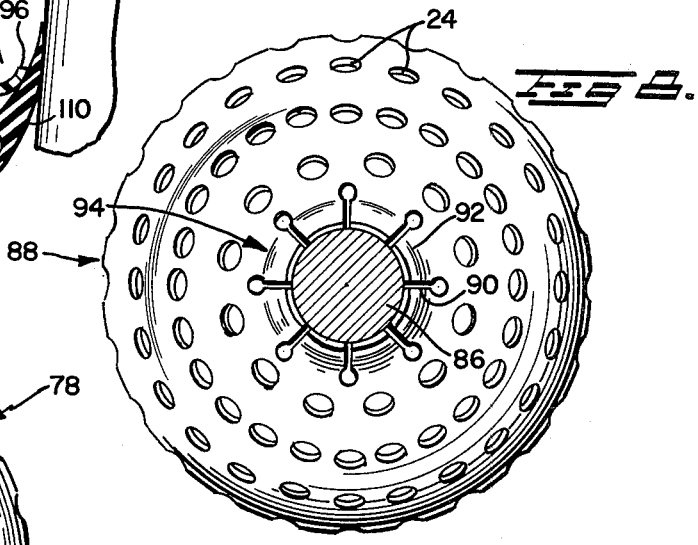
FIG. 8 is a view of the bat and exercise device illustrated in FIG. 7, taken substantially along line 8—8 of that Figure.

Turning again to the drawing, FIGS. 7 and 8 show that the exercise devices I have invented are as adaptable to bats with tapered barrels as they are to those with the straight or cylindrical barrels just described.

In the figures just identified, the bat is identified by reference character 84; and it has a uniformly tapered barrel 86.

The exercise device 88 assembled to bat 84 is identical to that identified by reference character 78 in FIG. 6 except that the slits 90 which define the tabs 92 of frictional coupling 94 are shorter than those (not shown) which delineate the tabs 96 of coupling 98. By this simple expedient, the two sets of tabs 92 and 96 can easily be fabricated to produce an optimal grip on the two differently dimensioned parts 100 and 102 of softball bat barrel 86.

FIG. 9 depicts, in fragmentary form, the same softball bat 84 shown in FIGS. 7 and 8 and an exercise device 104 which differs from those discussed above by virtue of an additional coupling 106 for frictionally securing the exercise device to bat 84.

The latter is employed at the barrel end associated extremity of the exercise device. It has a flexible link or strap 108 and an integral, tapered, typically wedge shaped member or head 110. The end of strap 108 opposite head 110 is secured to the shell 111 of the exercise device by a fastener 112.

Exercise device 104 is installed on bat 84 in the manner discussed above in conjunction with that application of my invention illustrated in FIG. 6. The wedge shaped head 110 of frictional coupling 106 is then forced between the barrel 86 of bat 84 and one (or two) of the tabs 96 of frictional coupling 98 to more securely fasten the exercise device to the bat.

Variations on the theme illustrated in FIG. 9 can be employed.

For example, particularly in exercise devices of smaller diameters, the use of a frictional coupling like that identified by reference character 106 can be substituted for couplings of the type identified by reference character 98 rather than being employed in addition to the latter.

Also, particularly if the foregoing variation is employed, the hollow sphere 110 of the device can be made of a rigid material which, particularly in large sized devices, is an advantage for the reasons discussed above.

FIG. 10 depicts yet another system which may be employed to secure an exercise device of the type illustrated and described above to a player swung device in accord with the principles of my invention. In this figure, the exercise device is identified by reference character 114. The player swung device on which it is assembled is, again, the tapered barrel softball bat 84 first illustrated in FIG. 7.

The exercise device has a shell 116 of the construction previously discussed. Openings 118 (only one of which is shown) are formed in shell 116 at opposite ends of a major diameter.

The frictional coupling 120 employed in this embodiment of my invention, and assembled to shell 116, includes a generally cylindrical grip 122 and a Velcro fastener 124.

Grip 122, which is fabricated of an at least to some extent resilient material, has a tubular portion or clamp 126 dimensioned to generally match the corresponding or associated portion of the player swung device but readily slidable relative to that device. This part of the grip is typically thinly sectioned so that it can be deformed into frictional contact with the player swung device.

The grip also includes a base 128, typically more thickly sectioned for structural integrity. A circumferential slot 130 is formed in the base.

With the exercise device 114 assembled, that part of shell 116 bounding opening 118 fits in slot 130, securing the grip 122 of frictional coupling to shell 116 of the exercise device.

The final component of frictional coupling 120; viz., Velcro fastener 124, includes an elastic cinch or strap 132 adhesively or otherwise bonded at one end to the tubular, flexible and deformable portion 126 of frictional coupling grip 122. The opposite end of strap 132 is faced with conventional, commercially available, Velcro or similar material as is that part of grip 122 opposite the just referred to end of the fastener. These two facings are identified in the drawing by reference characters 134 and 136, respectively.

Exercise device 114 is installed on, or assembled to, bat 84 in that manner described above. Then, the strap 132 is first stretched and tightened around grip 122 to deform or collapse grip segment 126 against the associated part 138 of bat 84 and produce a frictional coupling therebetween. The free end of the strap is then pressed against the bat to couple the two Velcro facings 134 and 136 together and secure the free, Velcro-faced end of the strap in place.

Many embodiments of my invention have been disclosed above and still others will be obvious to those skilled in the arts in which my invention lies.

For example, a central tubular component concentric with a major diameter of the drag generating exercise device component can be employed to position the accessory on the player swung device with which it is associated and to frictionally secure the accessory to the player swung device.

As another example, the exercise device can be molded onto or with, or otherwise fabricated as an integral part of, the player swung device rather than being made as an attachment or accessory.

Furthermore, the drag generating component of the accessory can be of a non-spherical configuration as long as the accessory approaches, or is essentially, aerodynamically neutral. In fact, when factors such as the offset to aerodynamic neutrality attributable to the accessory supporting part of the player swung device or the velocity with which the device is swung are taken into account, configurations based on other surfaces of revolution, but approaching spherical, may prove superior in this respect.

The invention may therefore clearly be embodied in forms other than those shown in the drawing without departing from the spirit or essential characteristics thereof. The illustrated embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by U.S. Letters Patent is:

1. An accessory adapted to be attached to a player swung device to promote the development of muscular strength and/or coordination as said device is swung, the player swung device having a barrel or other shaftlike portion and said accessory being a hollow, thin shelled globe or ball capable of generating an aerodynamic drag which remains essentially constant, or approaches a constant, as said device is swung, means defining a pair of enlarged openings concentric with a polar axis of said drag generating component through which the shaftlike portion of the player swung device extends, a pair of means for frictionally engaging said accessory to the shaftlike portion of the player swung device, one at each of said openings, each of said pair of means for securing the accessory to the player swung device comprising an annular array of juxtaposed, resiliently deflectable tabs formed in said globe about the enlarged opening, said array being concentric with, and said tabs extending radially inwardly toward, and having their free ends nearest, the polar axis of said globe, each of said tabs having a major portion of one of its surfaces in face to face, frictional engagement with the surface of the barrel of the player swung device after mounting of the accessory thereon, to thereby assure fixed engagement of the accessory onto the player swung device, and means defining an array of uniformly spaced, equal sized through openings of predetermined diameter formed throughout the surface of said globe, for providing the desired aerodynamic drag as the device is swung with the accessory mounted onto the device, the diameter of said ball being within the range of 2 inches to 18 inches.

2. A combination as defined in claim 1 wherein the ratio of the diameter of the openings to the diameter of the drag generating component is not greater than 0.3:1.

3. A combination as defined in claim 1 wherein the ratio of the diameter of the openings to the diameter of the drag generating component is ca. 0.1:1.

* * * * *